US009039228B1

(12) United States Patent
McCorkle

(10) Patent No.: US 9,039,228 B1
(45) **Date of Patent: *May 26, 2015**

(54) FLASHLIGHT HOLDER

(71) Applicant: Christopher McCorkle, Scottsdale, AZ (US)

(72) Inventor: Christopher McCorkle, Scottsdale, AZ (US)

(73) Assignee: 1445 Designs Corporation, Scottsdale, AZ (US)

( * ) Notice: Subject to any disclaimer, the term of this patent is extended or adjusted under 35 U.S.C. 154(b) by 11 days.

This patent is subject to a terminal disclaimer.

(21) Appl. No.: 13/945,748

(22) Filed: Jul. 18, 2013

Related U.S. Application Data

(60) Provisional application No. 61/673,059, filed on Jul. 18, 2012.

(51) Int. Cl.

| | |
|---|---|
| ***A42B 1/24*** | (2006.01) |
| ***F21V 21/00*** | (2006.01) |
| ***F21V 19/00*** | (2006.01) |
| ***A42B 3/04*** | (2006.01) |

(52) U.S. Cl.
CPC ..... *F21V 21/00* (2013.01); *F21V 19/00* (2013.01); *A42B 1/244* (2013.01); *A42B 3/044* (2013.01)

(58) Field of Classification Search
CPC . F21V 21/084; F21V 21/0855; F21V 21/145; F21V 21/08; F21V 1/088; F21L 15/14; A42B 3/044; A42B 3/0446; A42B 1/242; A42B 1/244; A61B 1/0692
USPC ..... 362/164, 105, 106, 396, 457
See application file for complete search history.

(56) References Cited

U.S. PATENT DOCUMENTS

| | | | | |
|---|---|---|---|---|
| 2005/0174752 | A1* | 8/2005 | Soo | 362/105 |
| 2009/0190332 | A1* | 7/2009 | Sharrah | 362/105 |
| 2009/0283558 | A1* | 11/2009 | Wanzer | 224/181 |
| 2012/0099333 | A1* | 4/2012 | Wang | 362/396 |
| 2012/0236543 | A1* | 9/2012 | Torgerson | 362/106 |

* cited by examiner

*Primary Examiner* — Julie Bannan
(74) *Attorney, Agent, or Firm* — Schmeiser, Olsen & Watts LLP

(57) ABSTRACT

A flashlight holder for a brimmed helmet. The holder is formed of a body having a flashlight receiving section and a mounting section, the flashlight receiving section comprising a channel configured to repeatably and releasably retain a flashlight body and a coupling device, wherein the coupling device adjusts the friction between the flashlight receiving section and the flashlight body. The mounting section of the body of the holder includes a mounting slot engageable with the brim whereby the flashlight is held in a position beneath the brim substantially at the wearer's eye level and not extending substantially past the edge of the brim.

1 Claim, 7 Drawing Sheets

FLASHLIGHT HOLDER

CROSS REFERENCE TO RELATED APPLICATIONS

This application claims priority to U.S. Provisional patent application to Christopher McCorkle entitled "FLASHLIGHT HOLDER," Ser. No. 61/673,059, filed Jul. 18, 2012, the disclosure of which is hereby incorporated entirely herein by reference.

BACKGROUND OF THE INVENTION

1. Technical Field

This invention relates generally to a flashlight holder and more particularly to a flashlight holder for headgear and helmets.

2. State of the Art

Flashlights are widely used by workers in various fields, such as construction workers, miners, firefighters and others who, in the course of performing their duties, require the use of a light in order to see to perform the required task. Miners and construction workers often work in dark or dimly lit areas. Firefighters often enter dark or smoke-filled areas. All of these individuals may require light for illumination, and also require the ability to use both hands to perform their duties. If it becomes necessary for these individuals to hold a flashlight in one hand for illumination, their ability to effectively and safely operate equipment and perform is seriously impaired. Additionally, these workers typically wear gloves on their hands while performing, and said gloves can impair the ability to effectively handle, insert or adjust a flashlight within the holder.

Typically, lights have been secured to the front of various types of helmets, hard hats, or headgear used in mining, construction and firefighting fields. These lights can become easily dislodged or entangled in surrounding structure while in dangerous conditions, and may be difficult to adjust while the worker is wearing gloves.

Additionally, other types of brackets and holders have been developed which are more specifically for helmets of the type worn by firefighters. These other types of brackets and holders are lacking in their ability to provide a holder where a user can quickly and effectively insert, adjust, or remove the light, especially while the user is wearing gloves, and still prevent accidental dislodging of the light due to accidental impacts to the helmet and brackets or holders. Accordingly, there is a need for an improved flashlight holder.

DISCLOSURE OF THE INVENTION

The present invention relates to a flashlight holder that is removeably securable to the brim of a headgear having a crown with an extending brim. The holder allows for easy removal and coupling of a flashlight within the holder, while still inhibiting the dislodging of the flashlight, and preventing the engagement or entanglement of the flashlight in structure or wiring that the wearer may encounter while performing duties.

The present invention accomplishes the above by providing a holder which is fabricated from a suitable fire-resistant material such as aluminum or composite plastic. The holder has a body which contains a channel configured to receive multiple types of flashlights commonly used by workers in the mining, construction, and firefighting fields. The holder contains a coupling device to further secure the flashlight and prevent the flashlight from rotational or axial movement. The holder contains a defined mounting section which is removeably securable to a helmet brim and positions the flashlight beneath the brim of the helmet to prevent dislodging and inhibiting engagement or entanglement of the flashlight.

Embodiments include a holder for securing the body of a flashlight to the brim of a helmet having an edge. The holder is formed of a body having a flashlight receiving section and a mounting section, the flashlight receiving section comprising a C-shaped channel configured to repeatably and releasably retain a flashlight body, and a coupling device, wherein the coupling device adjusts the friction between the flashlight receiving section and the flashlight body. The mounting section of the body of the holder comprises a defined mounting slot engageable with the brim of a helmet whereby the flashlight is held in a position beneath the brim substantially at the wearer's eye level and not extending substantially past the edge of the brim. The mounting slot extends into the body of the holder and secures to the helmet brim via the use of a suitable fastening means. The configuration of the flashlight receiving section is a semi-circular geometrically-defined cross-section configured to receive multiple types of flashlights commonly used by workers. The configuration of the flashlight receiving section is such that the flashlight will be held in place by frictional clamping force provided when the flashlight is inserted into the channel. The holder is comprised of a semi-rigid resilient material that retains the flashlight by providing clamping force when the flashlight is inserted into the flashlight receiving section. The coupling device adjusts friction to prevent the flashlight from rotational or axial movement while inserted within the flashlight receiving section. Further, the holder contains an aperture that extends through the body of the holder and a recess to accept a keyed attachment tool for ease of access.

An important feature of the present invention is the orientation of the mounting slot relative to the flashlight receiving section. The orientation of the mounting slot is such that, when mounted on the helmet brim, the flashlight is maintained in a position extending along and beneath the lower edge of the helmet brim at eye level.

Another embodiment includes a system for securing a flashlight to a brim of a helmet. The system comprises a helmet with a brim, a flashlight, and a flashlight holder. The flashlight holder comprises a body having a flashlight receiving section and a mounting section, the flashlight receiving section comprising a C-shaped cross-section forming a major arc configured to repeatably and releasably retain a flashlight body, and a coupling device. The flashlight holder further includes a flashlight coupling device for securing the flashlight in the flashlight receiving section. Additionally, the mounting section of the body of the holder comprises a mounting slot engageable with the brim whereby the flashlight is held in a position beneath the brim substantially at a wearer's eye level and not extending substantially past the edge of the brim.

Yet still, another embodiment includes a method of using a flashlight holder. The method comprises inserting a body of a flashlight into a C-shaped channel of a flashlight receiving section of a flashlight holder; securing the body of the flashlight within the receiving section by a combination a clamping force produces by the C-shaped channel formed of semi-rigid resilient material and operation of coupling device of the flashlight holder; coupling a mounting section of the flashlight holder to a brim of a helmet by use of a fastening means; and orienting the flashlight holder to direct a beam of light from the flashlight in a direction related to a line of sight of a user.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, the Figures are not necessarily drawn to scale, and:

DETAILED DESCRIPTION OF EMBODIMENTS OF THE INVENTION

Embodiments of the present invention relate to a flashlight holder that is removeably securable to the brim of a helmet having a crown with an extending brim. The holder allows for easy removal and coupling of a flashlight within the holder, while still inhibiting the dislodging and preventing the engagement or entanglement of the flashlight in structure or wiring that the wearer may encounter.

The present invention will be described for use in conjunction with a helmet of the type typically worn by firefighters. It is to be understood that the flashlight holder may be used with other types of helmets and headgear having a brim such as construction hats and miner's helmets.

Figure 6:
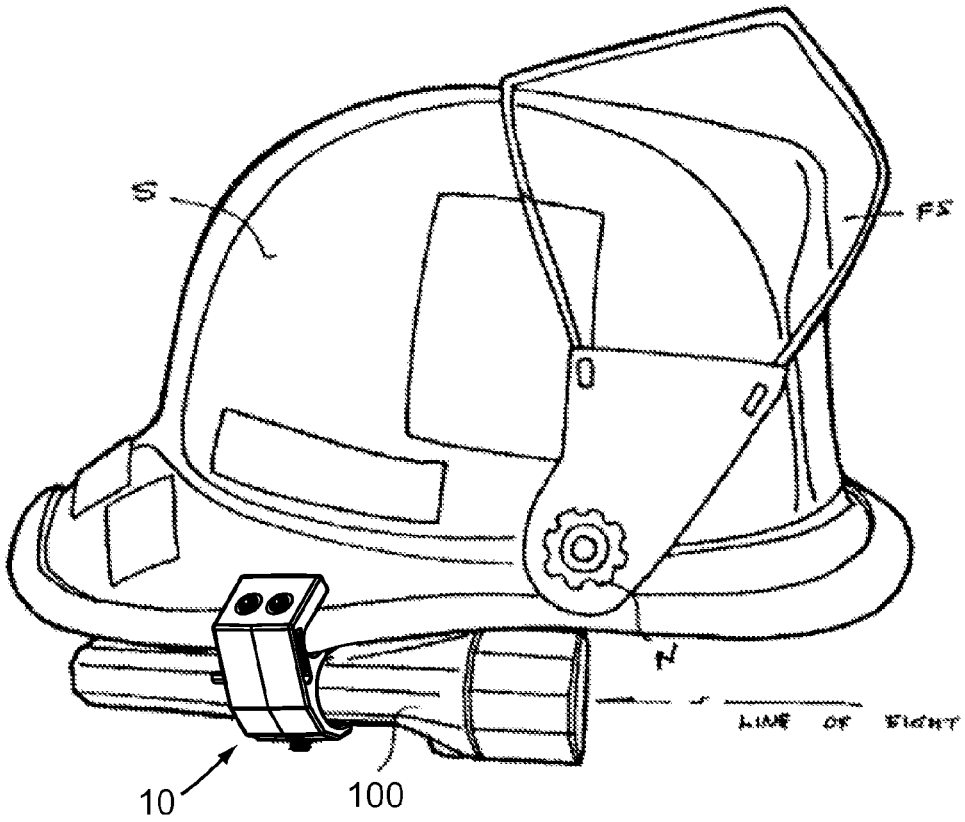
FIG. 6 is a perspective view showing the holder and contained flashlight secured to a helmet of the type worn by firefighters.
Figure 7:
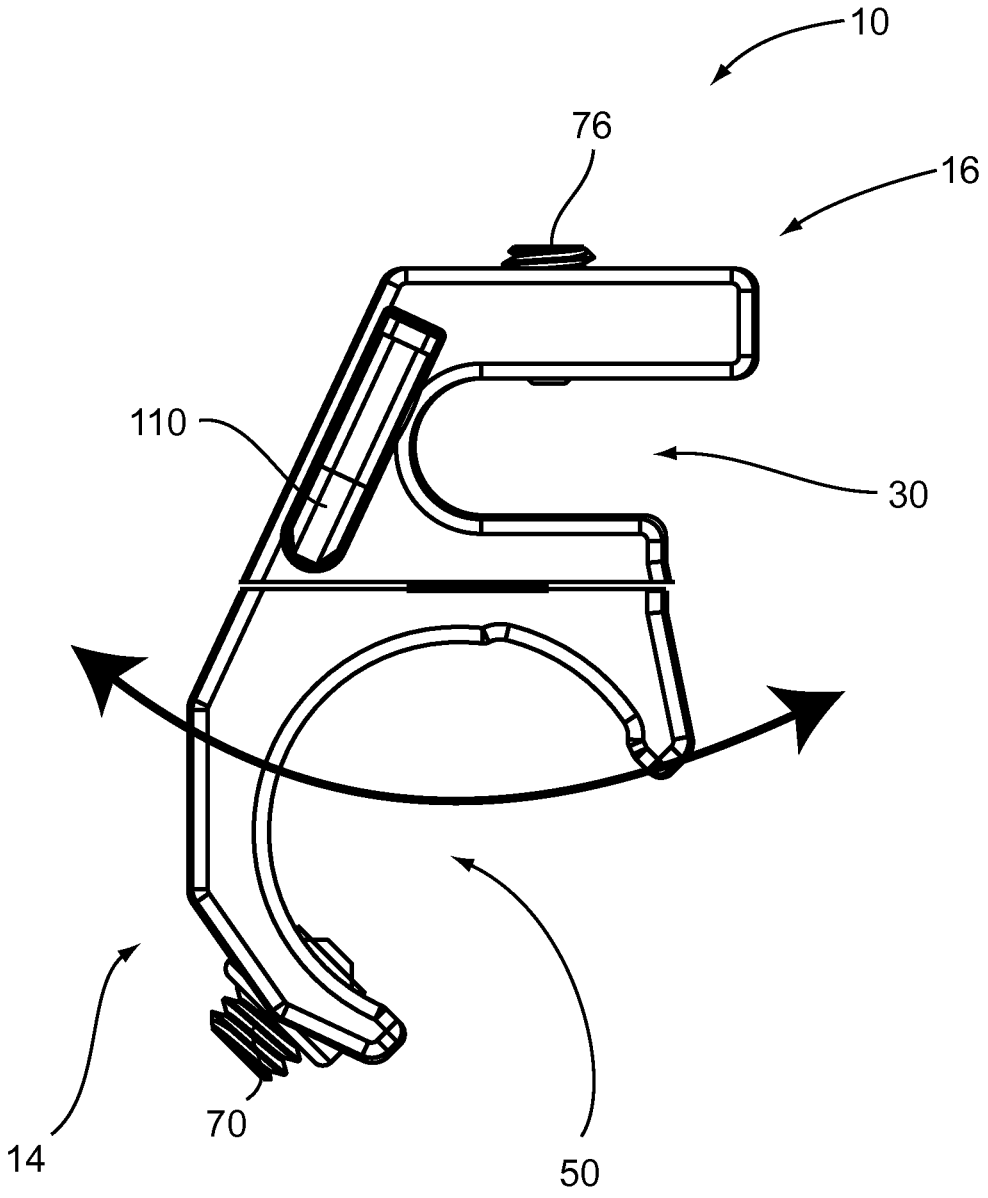
FIG. 7 is a side view of a flashlight holder with a flashlight receiving section that is rotatably coupled to a mounting section.

Firefighter's helmets generally, as shown in FIG. 6, have a hard shell S which receives the head of the wearer. The hard shell S is generally made of a high performance thermoplastic and has a transparent face shield FS which is adjustable at pivot locations P at the side of the helmet. The face shield FS can be elevated to a position above the eyes of the wearer or to a position in front of the wearer's eyes and locked in place in one of a number of several positions by nuts N at the pivot point. FIG. 6 shows the face shield FS in a raised position.

The shell is generally adjustable to the wearer's head size and includes a resilient cushioning or impact-absorbing material. An ear or neck protector of a material such as Nomex may be attached to the liner. A chin strap is provided to secure the helmet in place. These features are not shown as they are common features of helmets of this type. The bottom of the shell S terminates at an outwardly extending brim B which extends entirely around the shell and may project rearwardly a distance to protect the ear and neck areas of the wearer. The edge of the brim may have a circumferentially extending, resilient edging bead E, as shown.

The foregoing description of fire helmets is provided as general background to facilitate the understanding and the advantages of the present invention. As pointed out above, while the flashlight holder of the present invention has particular application for use in connection with fire helmets, it is understood the flashlight holder may be used with various type helmets having similar general features as set forth above.

Referring to the drawings, FIGS. 1-6 depict a flashlight holder 10 according to particular embodiments of the present invention. The flashlight holder 10 comprises a body 12. The body 12 has a flashlight receiving section 14 and a mounting section 16. In some embodiments, the body 12 may be a unitary or integral body wherein the flashlight receiving section 14 and the mounting section 16 are integral with one another. In other embodiments, the body 12 may further include a spring steel C-shaped clip that is coupled to the mounting section 16. The body 12 as shown has generally planar walls 18, 20, 22 and sidewall 90, 91. It will be understood that other embodiments may not include planar walls 18, 20, 22.

A mounting slot 30 extends upwardly from wall 24 and is defined by spaced-apart sidewalls 32, 34. Sidewalls 32, 34 converge at inner or lower end 36. The width of the slot is selected to conform to the thickness of a peripheral edge of a helmet on which the holder 10 is to be installed. A flange 40 extends parallel to the slot and is defined by walls 34 and 35. The upper end of the flange wall 35 converges into wall 18.

In the flashlight receiving section 14, an opening 50 is formed. The opening may be a channel 50, and may have various geometric cross-sections but is shown as having a general C-shape that extends from a first surface 90 to a second surface 91, the C-shape forming a major arc, wherein a major arc has an arc measurement of more than 180 degrees and less than 360 degrees. The channel is configured to repeatably and releasably retain a flashlight using frictional clamping force.

The flashlight receiving section 50 may be other shapes to conform to the style of flashlight 100 with which the holder 10 is to be used. A typical flashlight 100 used by workers has a body with an elongated handle section which is circular and has a head end having a lens. The circular body of the flashlight is typically made of a slip-resistant material such as rubber.

Figure 1:
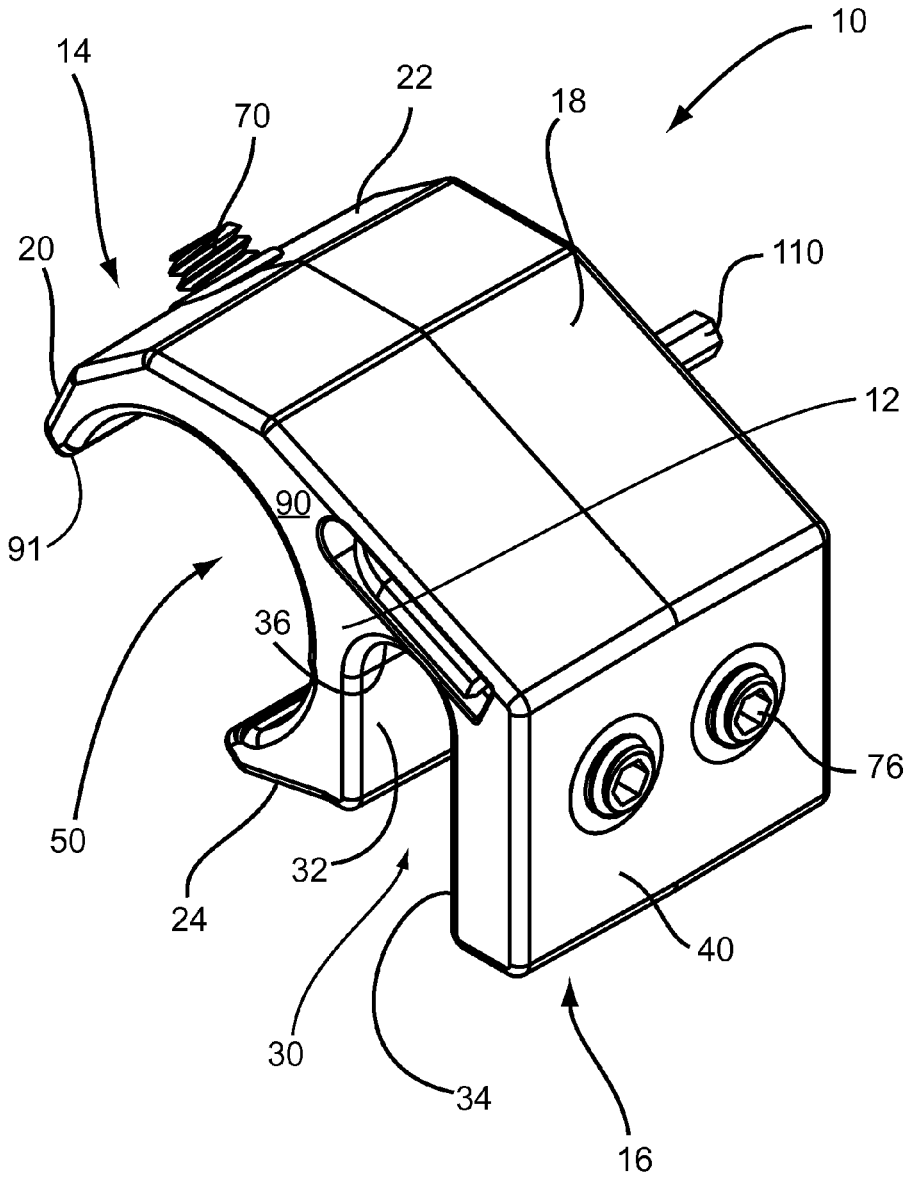
FIG. 1 is a perspective view of a flashlight holder.
Figure 2:
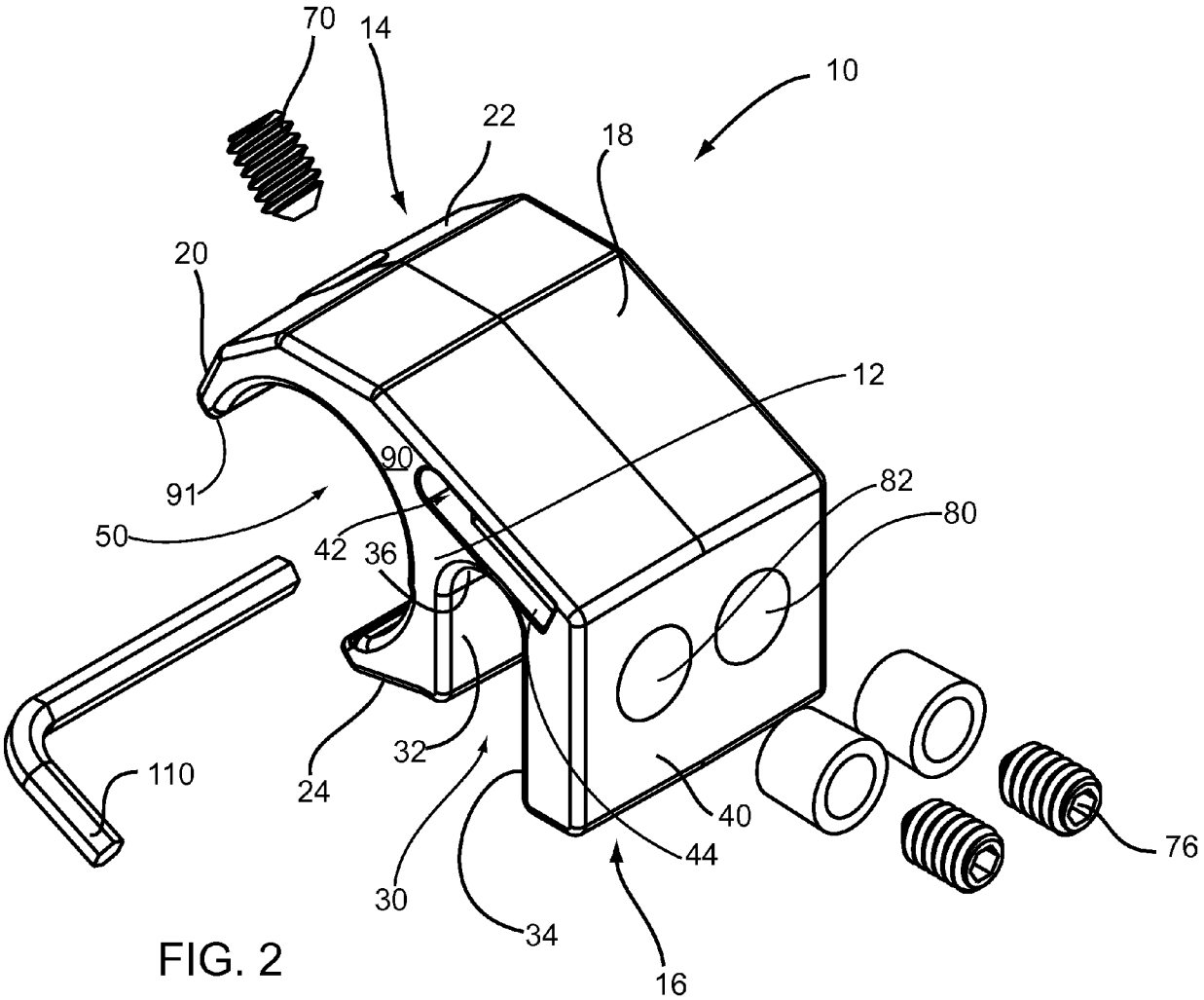
FIG. 2 is an exploded perspective view of a flashlight holder.
Figure 3:
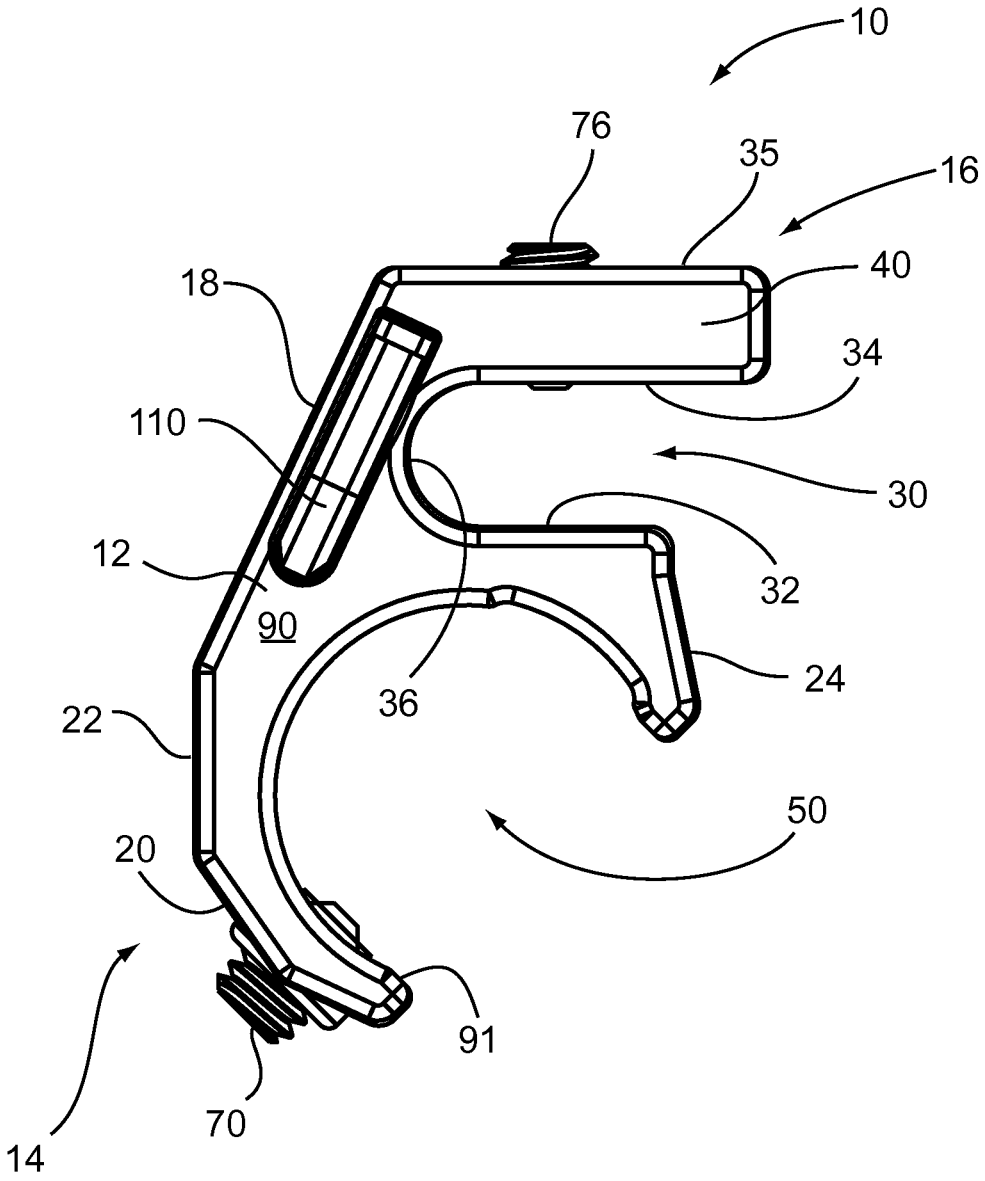
FIG. 3 is a side view of a flashlight holder.
Figure 4:
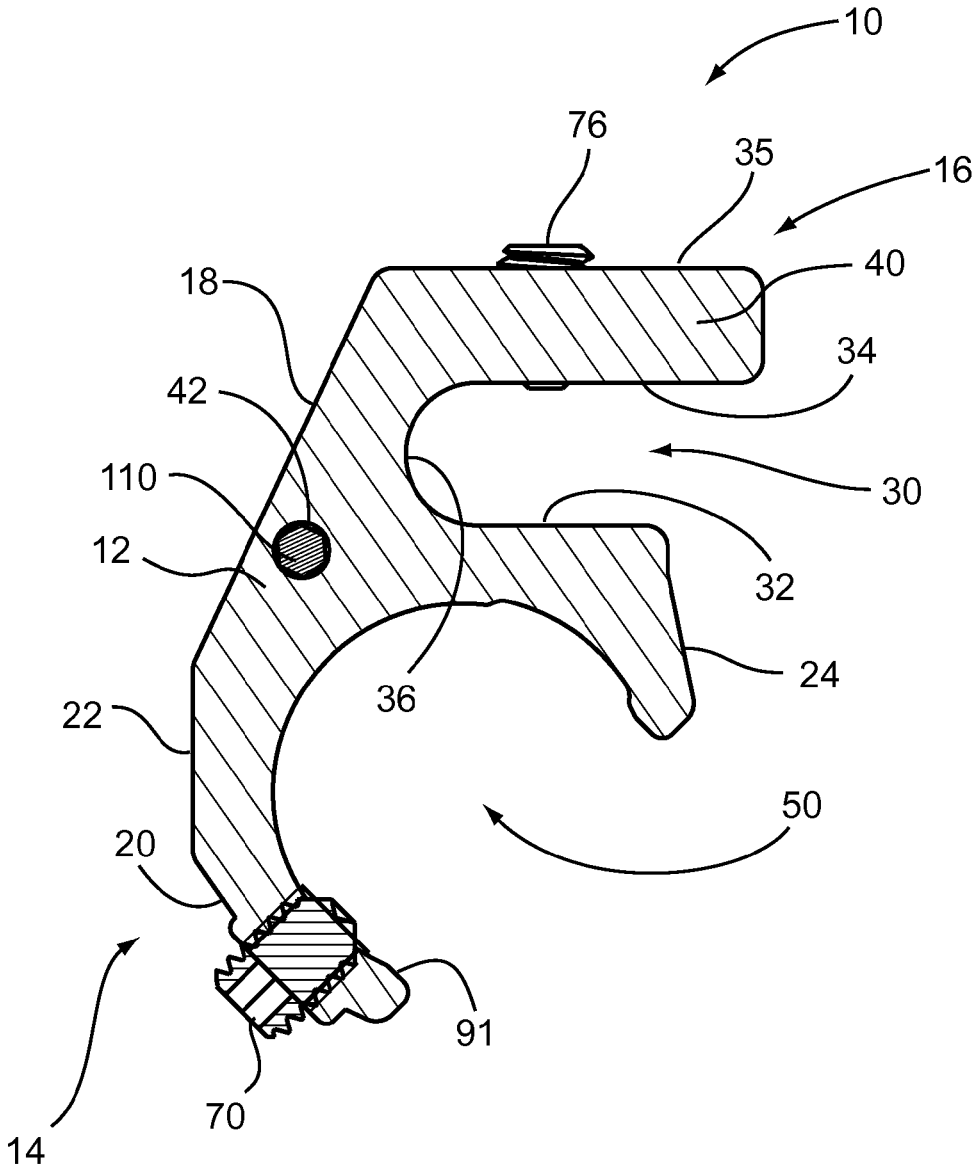
FIG. 4 is a side section view of a flashlight holder.
Figure 5:
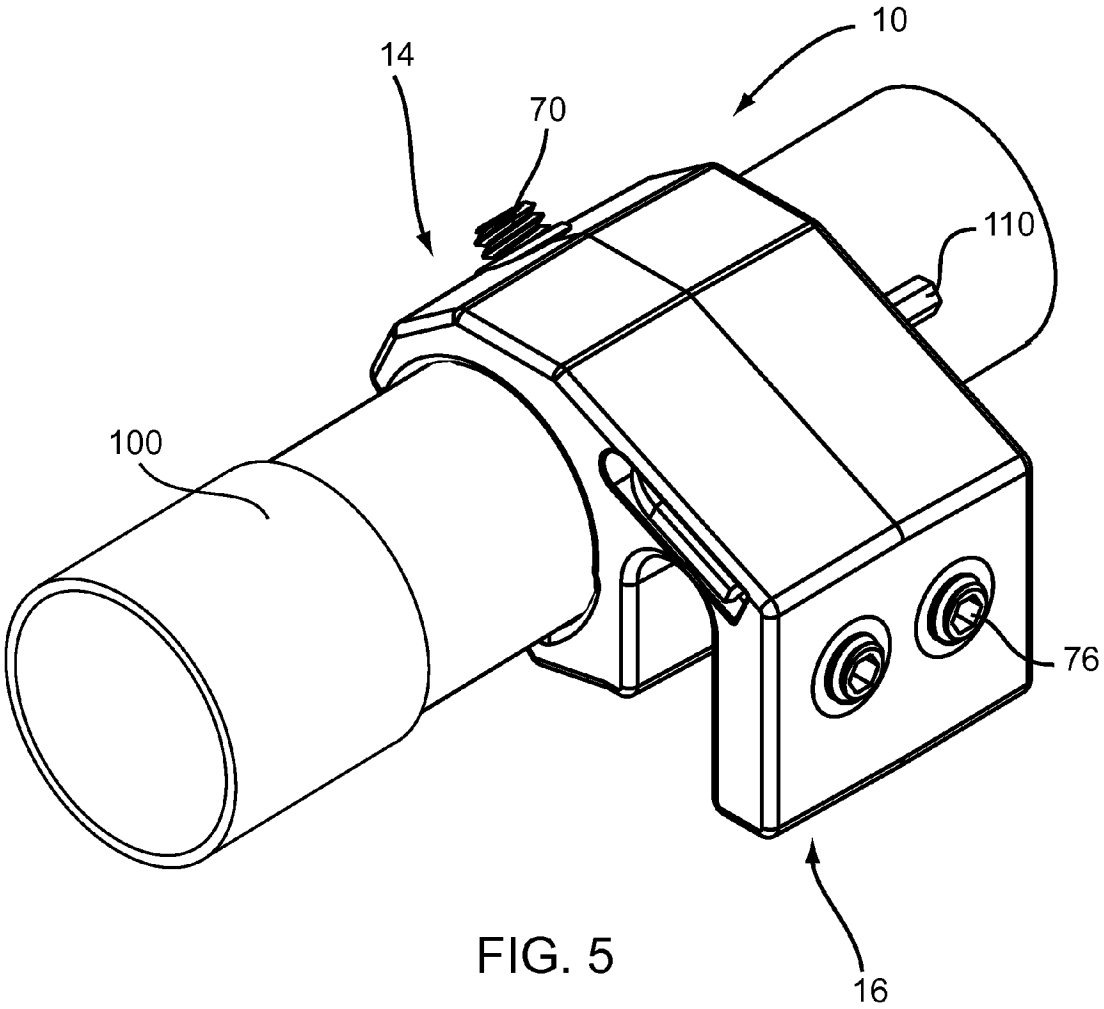
FIG. 5 is a perspective view showing the holder with a flashlight coupled within it.

Referring again to the mounting slot 30, the orientation of the mounting slot 30 relative to flashlight receiving section 14 is an important feature of the invention. The depth of the mounting slot 30 extends approximately to the location of the channel 50 wall. When the holder 10 is engaged with the brim of the helmet, as shown in FIG. 5, the channel 50 is disposed so the flashlight is maintained extending forwardly beneath the brim of the helmet. Further, the distance between the top surface portion of the channel 50 and the lower end 36 of the slot 30 is relatively small so that the flashlight 100 is maintained in a position in which the body of the flashlight 100 is beneath the brim of the helmet to improve the security of the flashlight 100. Also note in this position, the flashlight is maintained by the holder 10 in a position in which it does not project substantially beyond the helmet edge minimizing the possibility of snagging or engaging structure or wires in the area in which the firefighter is working. It will be understood that while some embodiments of the present invention locate the flashlight beneath the brim, in other applications and uses, the holder 10 may hold the flashlight above the brim.

Another important feature of embodiments of the present invention is that the lens of the flashlight 100 is at an elevation which is parallel and aligned with the line of sight of the wearer. Thus, a face shield of the helmet may be placed in the lowered position in front of the face of the wearer and the holder and the light will not interfere with the normal use of the shield. The flashlight being oriented in a line of sight position will move with the wearer's head with the beam of the light oriented at the area which the wearer is viewing. Also note that in certain embodiments, flange 40, the edge of the helmet and the planar walls 18, 20, 22 and 24 all contribute to safety and minimization of snagging or engagement with objects. Further, the planar walls 18, 20, 22 and 24 surround portions of the flashlight that are most likely to receive an accidental impact during use. Because of the location of the slot 30, the body 12 of the holder 10 operates to absorb the impact and prevent dislodging of the flashlight 100 during an accidental impact.

The flashlight 100 may be frictionally held within the channel 50. In order to adjust the friction securement, a coupling device 70 is operatively coupled to the flashlight receiving section 14. In some embodiments, the coupling device 70 is a set screw that extends through an aperture formed through the bottom planar wall 20 and into the channel 50. In embodiments, the set screw 70 may be rotated to extend the screw 70 further into or retract out of the channel 50 to intercept the flashlight 100. The further the set screw 70 is extended into the channel 50, the greater friction there is between the coupling device 70 and the flashlight 100. Additionally, in some embodiments of the present invention, the body 12 may be formed of a semi-rigid material that has a certain amount of flex. The flex allows for the channel 50 to expand a certain radial distance to facilitate inserting and removing the flashlight 100 within the channel 50 without having to adjust the coupling device 70. Accordingly, the flex of the material of the body 12 is biased to a resting position, the resting position providing the friction, or clamping force, necessary to maintain the flashlight within the flashlight receiving section 14. The coupling device 70 functions to provide additional securement to prevent the flashlight from rotational and axial movement, and adjust how much force is required to insert and remove the flashlight. At least in these ways, the coupling device 70 is operatively coupled to the flashlight receiving section 14.

The holder 10 is removeably secured to the helmet brim by engagement with mounting slot 30 and further held in position by a fastening means 76. Threaded bores 80, 82 are provided in flange 40 at an intermediate location and receive fastening means, such as screws 76. The screws 76 may be tightened into engagement with the brim of the helmet using an attachment tool 110. Once tightened, the screws will not project above the outer surface of flange 40.

The use of threaded fasteners, as set forth above, is an effective means of securing the holder 10 to the helmet and an attachment tool 110 and minimal time to secure, remove or adjust the holder 10. Once in position, the holder 10 can be adjusted forwardly or rearwardly along the brim in accordance with the preference of the wearer.

In some embodiments, as shown in FIG. 5, the holder 10 contains an aperture 42 that extends from a first surface 90 to a second surface 91 through the body 12 of the holder 10 with a recess 44 adjacent to the aperture 42. The aperture 42 is oriented to accept the attachment tool 110. The attachment tool 110 may be a keyed attachment tool, such as, but not limited to, an allen wrench, used to adjust the coupling device 70 and fastening means 76. The attachment tool 110 is held in the aperture 42 by friction and once inserted into the aperture 42 is substantially flush with the body of the holder 10 to prevent snagging or engagement with objects encountered while performing.

In another embodiment the mounting section 16 is rotatable with respect to the flashlight receiving section 14. The rotation provides greater flexibility in positioning the flashlight into more advantageous positions.

Embodiments of the present invention include a method of using a flashlight holder. The method comprises inserting a body of a flashlight into a C-shaped channel of a flashlight receiving section of a flashlight holder; securing the body of the flashlight within the receiving section by a combination a clamping force produces by the C-shaped channel formed of semi-rigid resilient material and operation of coupling device of the flashlight holder; coupling a mounting section of the flashlight holder to a brim of a helmet by use of a fastening means; and orienting the flashlight holder to direct a beam of light from the flashlight in a direction related to a line of sight of a user.

The method may also include removing an attachment tool from storage within the body of the flashlight holder; utilizing the tool to tighten the coupling device and the fastening means; and storing the attachment tool within the body of the flashlight holder. Other additional method steps may be apparent and utilized with regard to the flashlight holder, such as removing the holder from the brim of a helmet; removing the flashlight while the holder is still attached to the brim of the helmet; and rotating a flashlight receiving section with respect to the mounting section.

From the foregoing, it will be seen that an improved flashlight holder for helmets has been described. The holder has is easily removeably securable from the helmet. The holder provides safety features and secures the flashlight in a convenient position generally aligned with the eye level of the wearer. The holder secures the flashlight in a manner that the flashlight is more secure and less subject to being dislodged during use in conditions typically seen by firefighters and others that wear this type of headgear.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

I claim:

1. A method of using a flashlight holder, the method comprising:

inserting a body of a flashlight into a C-shaped channel of a flashlight receiving section of a flashlight holder;

securing the body of the flashlight within the receiving section by a combination a clamping force produces by the C-shaped channel formed of semi-rigid resilient material and operation of coupling device of the flashlight holder;

coupling a mounting section of the flashlight holder to a brim of a helmet by use of a fastening means;

orienting the flashlight holder to direct a beam of light from the flashlight in a direction related to a line of sight of a user removing an attachment tool from storage within the body of the flashlight holder;

utilizing the tool to tighten the coupling device and the fastening means; and storing the attachment tool within the body of the flashlight holder.

* * * * *